US009003715B2

(12) United States Patent
Nurdogan

(10) Patent No.: US 9,003,715 B2
(45) Date of Patent: Apr. 14, 2015

(54) ROOF ANCHORING SAFETY SYSTEM

(71) Applicant: Mark Nurdogan, Pine Brook, NJ (US)

(72) Inventor: Mark Nurdogan, Pine Brook, NJ (US)

( * ) Notice: Subject to any disclaimer, the term of this patent is extended or adjusted under 35 U.S.C. 154(b) by 0 days.

(21) Appl. No.: 13/670,100

(22) Filed: Nov. 6, 2012

(65) Prior Publication Data

US 2014/0123568 A1 May 8, 2014

(51) Int. Cl.

| | |
|---|---|
| ***B66B 9/00*** | (2006.01) |
| ***E04D 15/00*** | (2006.01) |
| ***E04D 1/30*** | (2006.01) |
| ***E04D 13/12*** | (2006.01) |
| *E04G 21/32* | (2006.01) |

(52) U.S. Cl.

CPC ..... *E04D 1/30* (2013.01); *E04G 21/328* (2013.01); *E04D 13/12* (2013.01); *E04D 2001/305* (2013.01); *E04D 2001/308* (2013.01); *E04G 21/3276* (2013.01)

(58) Field of Classification Search

CPC ..... E04G 21/3276; E04G 21/3285; E04G 21/3214; E04F 21/328; E04D 13/12

USPC ..... 248/237; 182/3; 52/29, 127.5, DIG. 12, 52/749.12

See application file for complete search history.

(56) References Cited

U.S. PATENT DOCUMENTS

| | | | | | |
|---|---|---|---|---|---|
| 4,606,430 | A | * | 8/1986 | Roby et al. | 182/3 |
| 4,767,091 | A | * | 8/1988 | Cuny | 248/228.4 |
| 5,143,170 | A | * | 9/1992 | Hunt et al. | 182/3 |
| 5,282,597 | A | * | 2/1994 | Babcock | 248/237 |
| 5,287,944 | A | * | 2/1994 | Woodyard | 182/3 |
| 5,370,202 | A | * | 12/1994 | Nichols | 182/3 |
| 5,558,312 | A | * | 9/1996 | Brennan | 256/67 |
| 5,581,955 | A | * | 12/1996 | Gleave | 52/27 |
| 5,595,260 | A | * | 1/1997 | Jalla | 182/3 |
| 5,727,646 | A | * | 3/1998 | Gray | 182/45 |
| 5,878,534 | A | * | 3/1999 | Gleave | 52/27 |
| D419,699 | S | * | 1/2000 | Stodola | D25/199 |
| 6,148,580 | A | * | 11/2000 | Weir | 52/651.1 |
| 6,668,509 | B1 | * | 12/2003 | Krebs | 52/698 |
| 7,832,153 | B2 | * | 11/2010 | Crookston | 52/127.5 |
| 8,028,477 | B2 | * | 10/2011 | Crookston | 52/127.5 |
| 8,256,183 | B2 | * | 9/2012 | Berlee et al. | 52/698 |
| 2012/0211619 | A1 | * | 8/2012 | Parquette | 248/237 |
| 2012/0222370 | A1 | * | 9/2012 | Crookston | 52/173.1 |

* cited by examiner

*Primary Examiner* — Elizabeth A Plummer

(74) *Attorney, Agent, or Firm* — Baker and Rannells, PA

(57) ABSTRACT

A roof anchoring safety device that may be retro fit to a roofing structure. The safety device is capable of being transitioned from an actuated state to a retracted state. When in a retracted state, the device is concealed. When in an actuated state, the device is capable of connecting to a safety tether. The device may be installed during initial build of roof an accessed in future for maintenance and or future additions therein. The device is concealed by a cap that is designed to prevent ingress of ambient matter.

14 Claims, 6 Drawing Sheets

ROOF ANCHORING SAFETY SYSTEM

I. BACKGROUND

A. Field of Invention

The present invention generally relates to building construction and safety. More particularly, the present invention relates to a safety device used in relation to construction and repair of roofs.

B. Description of the Related Art

During installation and repair of structures that have an elevation that could cause harm to an operator upon fall, it is necessary for the operator to utilize a safety device that can either prevent the fall or minimize the extent of injury that could be sustained therefore.

In the situation where the elevated structure relates to a roof, particularly a pitched roof, there are practices well-known and used in the field by operators to secure their person while working at dangerous elevations. For example, it is known that an operator on one side of a pitch may connect a safety line to its person and anchor the line to an object on the opposite side of the pitch. While this practice may be effective, integrity of these support structures may not be known until after an injury is sustained. Furthermore, a support may require additional effort in order to make it worthy or capable of connecting with a safety line.

Other known methods include attaching supports onto a portion of a finished or unfinished roof structure and securing a line thereto. Supports to this extent are usually nailed to a roof or connected therein by other known means that ultimately require subsequent repair to the roof to avoid damage attributable to weather such as leaks and pest entry. In some instances the supports may be left attached to the structure or roof and may be unsightly, not to mention may further lead to additional leak and or damage if the support is not installed properly or maintained.

There is a long felt need for a safety device that is capable of being attached to a roof during installation/fabrication, or that may be retrofitted therein wherein the anchor is accessible during use and is hidden when not in use.

II. SUMMARY

The current invention relates to a safety device to prevent and or minimize injury due to accidents that may occur at elevations. The safety device includes an embodiment wherein it comprises an anchor-type device that is capable of being mounted to a portion of a finished or unfinished roof, such as a truss, beam or rafter. The device may be retrofit to anchor to a truss or installed after construction of the structure is complete. An embodiment includes an anchor-type device wherein the device is shaped and designed to be able to connect to an operator such as by accepting a line therein that is connected at another end to an operator and or safety harness therein.

An embodiment of the invention includes a cap that comprises similar function as adjoining sheathing, but that said cap conceals an anchor-type safety device when the safety device is not in use.

Another embodiment of the invention includes accessing the anchor-type safety device by manipulating the cap such as by known means that cause ejection and or exposure of a portion of the safety device, in as much as a portion therein is accessible to be combined with means of supporting an operator, such as a rope, line, chain, or other ties known in the industry.

In an embodiment, the cap may be manipulated so that the anchor is selectively accessible and selectively concealed by an equal or opposing action of manipulation of said cap.

It is a further embodiment that the anchor may be hidden by a cap shaped and sized to resemble a usual or adjoining pattern of a similar structure roof or like such that the location of the anchor is indeterminable and or unobvious.

III. BRIEF DESCRIPTION OF THE DRAWINGS

The invention may take physical form in certain parts and arrangement of parts, some embodiments of which will be described in the specification and illustrated in accompanying drawings which form a part hereof, wherein, FIG. 1 is a perspective view of an embodiment of the invention showing in broken lines a retracted state and in solid lines an actuated state.

IV. DETAILED DESCRIPTION OF THE INVENTION

An object of the invention is to provide a safety device for a roof. In particular the invention comprises an anchoring device that may be attached to a portion of a roof, such as a support beam or ridge beam and is capable of satisfying ANSI and OSHA operational safety standards.

An object of the invention is to allow the retractable roof anchoring device to effectively be used as a safety device that is permanently attached to a structure either during installation of a roof or similar structure or attached as a retro-fit, in instance for example after a roof or similar structure is completed or installed, finished, and later accessed by an operator for example based on building code changes, other regulations, or when the structure may be maintained at some future time. An embodiment of the invention includes a retractable roof anchoring device that may be selectively biased to a roof structure, such that it may be transferrable between two states such as an operational and or actuated state and a retracted or storage state. In an actuated state a line and or tether may be connected at one end to an exposed portion of said anchor and the other end of said tether may be connected to an operator, by additional means that includes a harness for example. An embodiment of the invention is to preserve aesthetics and integrity of the roof or similar structure by removing need to use temporary anchoring or other safety devices commonly known and or used in industry that cause damage, are unsightly, or unreliable.

Figure 1:
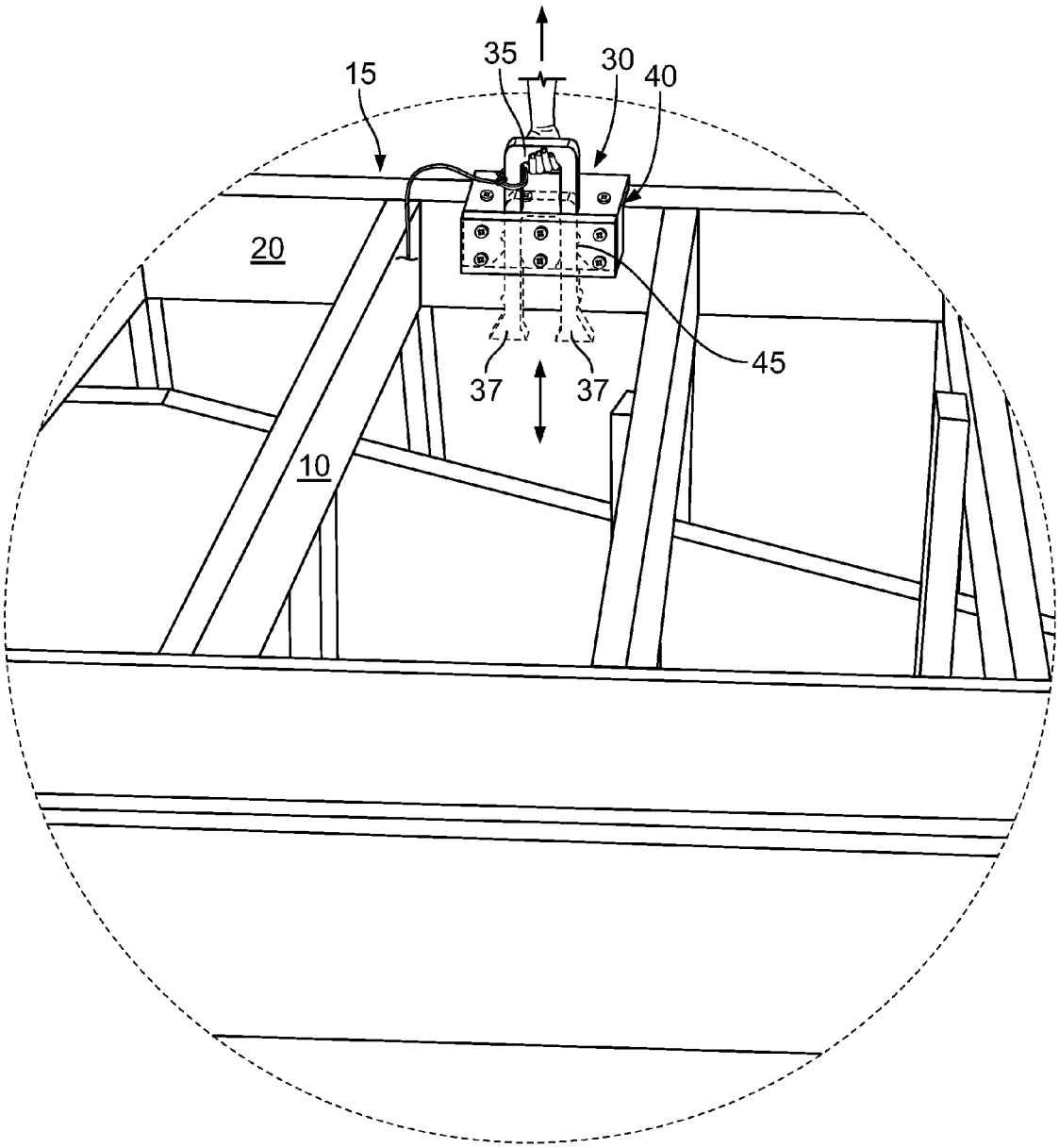

FIG. 1 shows an embodiment of a retractable roof anchoring device according to the invention, wherein dotted lines show the device in a retracted and storage state and solid lines show the device in an extended and or operational state. An embodiment includes an anchoring base and or roof structure 15 that has a region comprising truss (10,20) a mount 40 connected to said truss and an anchor 35 having a first portion for connecting to a safety line 16 and a second portion 37 that communicates with mount 40, so that the anchor can be transferred between a retracted state and an operational state. As shown, anchoring device 30 attaches to an anchoring base 15 such as a truss and or fame of a roofing structure that may consists of interconnected, ridge beam(s) 20 and or supporting beams 10 also known as rafters, for example. Mount 40 may be composed of any known material not limited to plastic, wood, metal, and so on.

In roofing operation or similar assembly, sometimes truss, frame or its portions thereof may be shipped partially assembled. And, once at site, portions thereof may be connected to a core weight bearing beam (or beams thereof) known as ridge beam 20, which are typically at higher elevations, respectively. During assembly, access to ridge beam 20 may be required, and depending on height or other hazardous variations therein, certain standards have been established in as much as ANSI and OSHA regulations must be followed to minimize or prevent injury during assembly (or maintenance). Therefore, it is an object of the invention that an embodiment of the anchoring device 30 satisfies the regulations in as much as it is capable of being easily accessible, capable of bearing load, and sufficient for purposes of height jobs that may relate to roofing maintenance, assembly and other operations.

In use, an operator, inspector, or worker therein, may attach a first end of a safety line 16 to a portion of anchor 35, and connect a second end directly to an individual or other thing being supported. In an embodiment safety line 16 may include a tether, line, or other known safety line, and said first end may connect to anchor 35 by a tie, clip, chain or other known means. Said second end (not shown) of safety line 16 may connect to a harness work by an individual or thing. As shown in FIG. 1, securing device 30 may connect to structure 15, such as a ridge beam 20, and comprise anchor 35 and mount 40, wherein anchor 35 may transfer from an actuating or extended position (as shown in solid lines) to a retracted position or storage position as indicated by direction of arrows (and as shown in broken lines). As shown, anchor 35 has a portion that extends up and away from mount 40, which may also be regarded as above a structures upper boundary. Said portion may be used as an area which can accept a first end of a tether line 16, for example. As shown, anchor 35 comprises an upside down U shape, having an upper portion 36 distal to mount 40 (i.e., extends up and away therefrom) may be used as a handle to grip and pull in an upwards direction to force the anchor in an actuated position as shown in FIG. 1, by a hand image.

Figure 2:
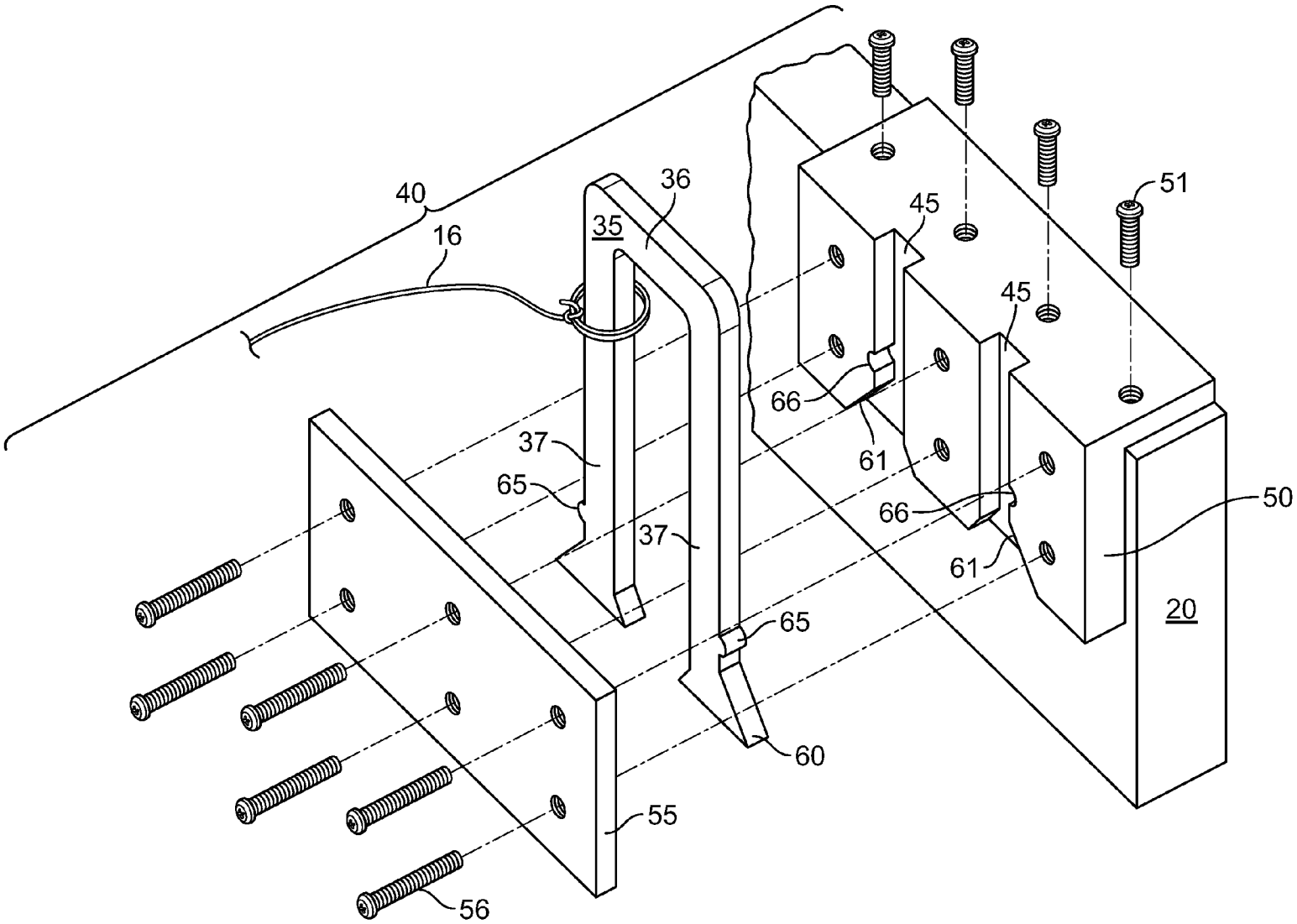
FIG. 2 is an exploded view of an embodiment of FIG. 1, showing how device may assemble.

FIG. 2 shows an exploded view of an embodiment of FIG. 1. As shown, mount 40 may comprise channels 45 formed therein such that anchor 35 can be guided between an operational state and storage state. As shown, an embodiment of anchor 35 includes an inverted U-shaped, horseshoe-type configuration wherein anchor 35 has two opposing legs 37 which are sized and shaped to have an outer diameter that is less than inner diameter of corresponding channel 45 such that anchor 35 may be converted from an operational state to a stored state. In an embodiment, legs 37 have a base portion 60 that functions as a stop to restrict movement of anchor 35 to prevent a disconnect. It is understood that by a portion of a leg having an outer diameter greater than inner diameter of channel 45 would restrict movement therein in as much as on leg may have a consistent diameter and other may have a portion proximal to the apex 36 of the "U" and distal to end of leg 37 sufficient to prevent a disconnect of anchor 35 with base 45.

Mount 40 may comprise two portions, a front plate 55 and a base plate 50. As shown, channels 45 are formed in base plate 50 and are bounded by front plate 55. Said channels being capable of containing, guiding and or directing leg(s) 37 from an actuated and or extended state to a retracted state. As shown, when plate 55 connects to base plate 50 channels 45 are formed therein, whereas anchor 35 is capable of being moved in between an actuated and a retracted state and likewise retained therein. It is understood mount 40 may essentially consist of a single unit that has channels formed therein that allows anchor 35 to extend and retract. It is understood that mount 40 may comprise a base plate and front plate, however the mount 40 may be formed in a single unit, such as by plastic and or metal molding, injections, and the like, and wherein channel(s) are preformed or drilled after the mount is fabricated. It is further understood that mount 40 may consist of a single channel. Additionally, mount 40 may consist essentially of a single C-bracket that when connected to a ridge beam below a structures upper boundary (or upper exterior boundary, for a finished roof) for example, forms a channel that allows an anchor to be extended and retracted therethrough. In such an embodiment, C-bracket may lay in a horizontal plane wherein ends of C-bracket may pass through holes formed in a ridge beam, for example, and secured by nuts on an opposing side of said beam.

Figure 3:
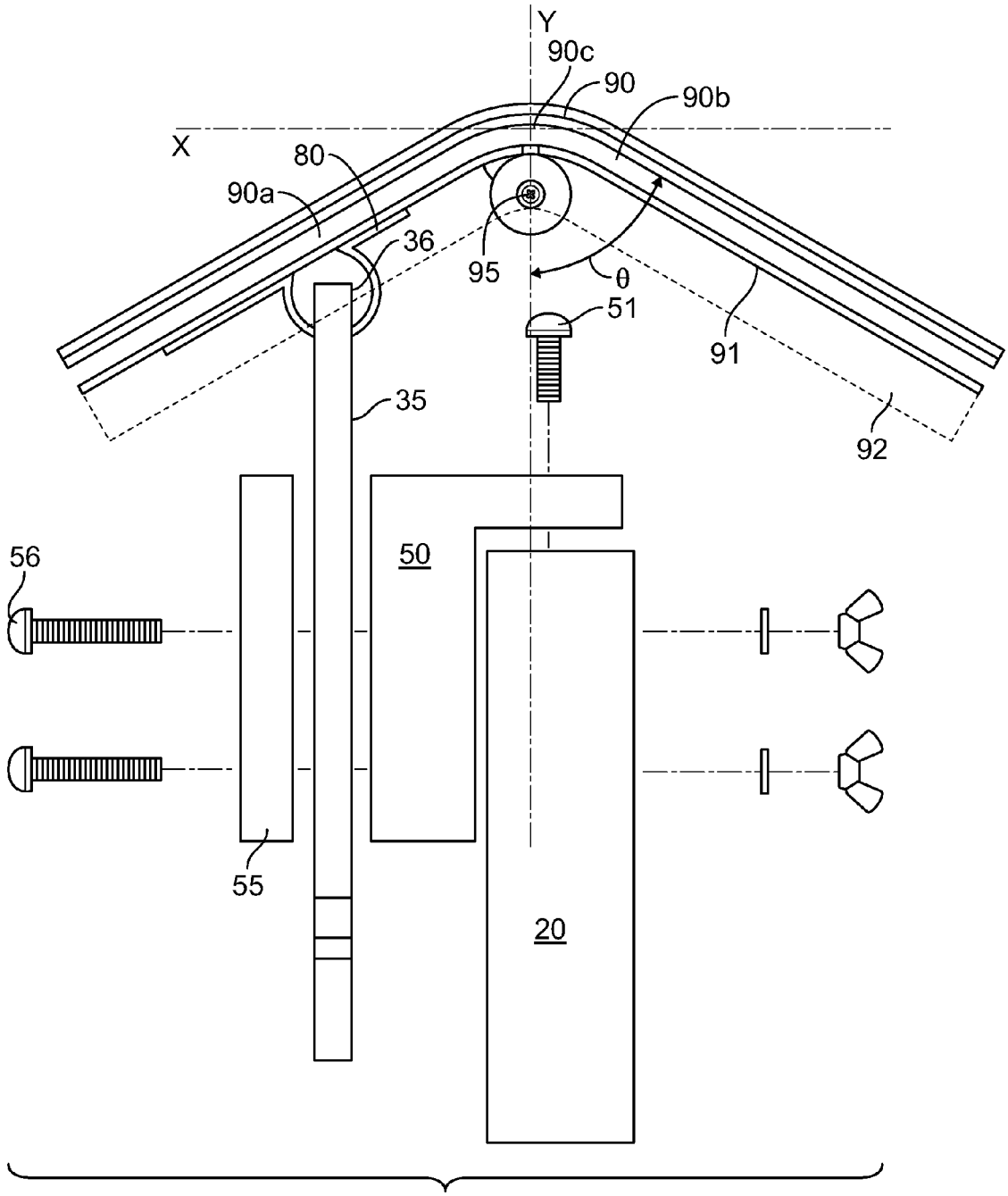
FIG. 3 is a side view of an embodiment of the invention.

FIG. 2 shows an embodiment as to how base plate 50 may be connected to ridge beam 20, for example by use of screws 51 securing upper area to ridge beam, and upon connection with front plate 55, by use of screws 56—which may secure to wood or be secured on opposite side by use of a washer nut combination as shown in FIG. 3. It is well within the scope of the invention for mount 40 to a structure by other means, which may be directly related to the composition of the mounting structure. For example, although it is typical a ridge beam may comprise wood, it is known that beams and other structures comprise metals such that the base 40 may be welded or brazed to a support structure such as a ridge beam.

As shown in FIG. 2, portions of leg 37 may be shaped and designed to correspond to base 50 to exhibit locking means. In an embodiment, a portion of leg 35 has an outer diameter greater than inner diameter of channel 45, such that movement of anchor 35 becomes restricted when inner diameter 45 is deformed. In an embodiment, for example, channel 45 may comprise a portion that may indent at 66 and or have a flare 61 region. Said portions may correspond to flare 37 and or dimple 65 such that when anchor 35 is transitioned from a retracted state to extended state, anchor 35 may effectively lock in the actuated state when corresponding regions 65 and 66 become engaged, and or when flare is friction fitted within 61 or both. In either embodiment, apex 36 of anchor 35 may be biased to a U-shape, but pliable to the extent that it can convert to a V-like shape, an I-like shape, or an O-like shape for purposes of engaging and disengaging leg dimple 65 with corresponding base portion 66 or said flare. Furthermore, leg 37 may have a consistent exterior diameter, however leg 37 may be biased in a V-like configuration such that friction of leg(s) against channel wall(s) 45 is sufficient to cause anchor 35 to seize movement. It is understood that other well-known locking means may be utilized for example, by a hole being formed through an upper portion of leg 37 proximal to apex 36 and distal to channel 45, that when a pin having a length greater than the diameter of channel 45 and is inserted there through, it shall prevent leg 37 from retracting through channel 45. Furthermore, depending on the user, a locking mechanism in an actuated state may be avoided as it is well-known that upon completion of a job, a user may forget to unlock the anchor which may cause unwanted affects associated with egress of water, dirt and rodents etc. Avoiding use of a lock may be a failsafe. Notwithstanding, as shown in figures, anchor 35 is capable of being maintained in an actuated state by use of locking means not limited to dimple engagement or other as disclosed herein or otherwise known. An advantage of a locking mechanism (or means) nevertheless, allows a single operator to access anchor 35 and connects itself or something therein without assistance. Additionally, while it is shown that locking means is used to secure anchor 35 in an actuated state, locking means may also be used to secure anchor 35 in a retracted and or storage state. Furthermore, it is an embodiment of the invention anchor 35 is biased in a retracted state.

While securing device 30 is shown connected to ridge beam 20, it may be connected to other load bearing rafters, beams or other fixtures therein. Because ridge beam 20 is typically a higher portion of structure 15 and capable of carrying utmost weight however, it may be preferred to designate ridge beam 20 as anchoring base. Nevertheless, more than one securing device(s) 30 may be used, in series, parallel or in other arrangements as may be determined depending on intricacies of a site or needs of users.

As shown in the figures, anchor 35 is U-shaped, which may be a preferred orientation or design as it can allow a user to grip rounded portion or apex 36 like a handle, and may also provide a stop when anchor 35 retracts and legs 37 pass through corresponding channels 45. In practice anchor 35 can be pulled up by an operator exposing a region and or portion of anchor 35 that shall be accessible and capable of accepting a tether or other safety line, which may be clipped thereon or tied or attached by other known methods, for example at or about apex 36.

FIG. 3 is a perspective view of embodiment shown in FIG. 2, wherein anchor 35 is connected to cap 90, which may be a shingle or ridge cap for example. In an embodiment cap 90 is hingedly connected to anchor 35, such that when anchor 35 is in a retracted state, a hinge allows cap 90 to lay and look as adjacent caps. In another embodiment cap 90 may also be insulated and or configured such that it will mimic the usual appearance of roofing and or adjacent shingles or ridge caps, such that it is disguised when in a retracted state. In particular, it is an embodiment of the invention that underside 91 of cap 90 comprise insulation 92 which may for example comprise a gasket, weather strip or other known sealant about perimeter of underside 91 such that when securing device 30 is in a retracted state insulation 92 prevents ingress of ambient matter which includes water, pests, dirt, weather, or other that would compromise integrity of whatever structure is under said shingle or ridge cap 90. It is understood that insulation 92 may coat entirety and or a portion of underside 91.

In an embodiment, cap 90 comprises two independent portions, 90*a* and 90*b*, that are connected to hinge 95 which may allow portions to pivot about axis 90*c* (at x,y) so that cap 90 will look and lay similar to adjacent caps about a structure. As shown, portions 90*a* and 90*b* are predominantly in a lower hemisphere of (x,y) and or predominantly in quadrant III and quadrant IV, respectively; however said portions may be in any configuration that includes respective quadrants II and I as well, depending on a structure. For example, portions 90*a* and 90*b* may be in quadrants II and I when device 30 is mounted in a valley region of a roofing structure. As shown in FIG. 3, cap portions 90*a* and 90*b* are about equally in a downward direction at an angle of θ, which may be in a range of about 10 degrees to about 90 degrees, or between 30 degrees and 60 degrees as shown when used as a ridge cap for example. Additionally, when used as a shingle, θ may be about 90 degrees for both 90*a* and 90*b*, and so on.

Figure 4:
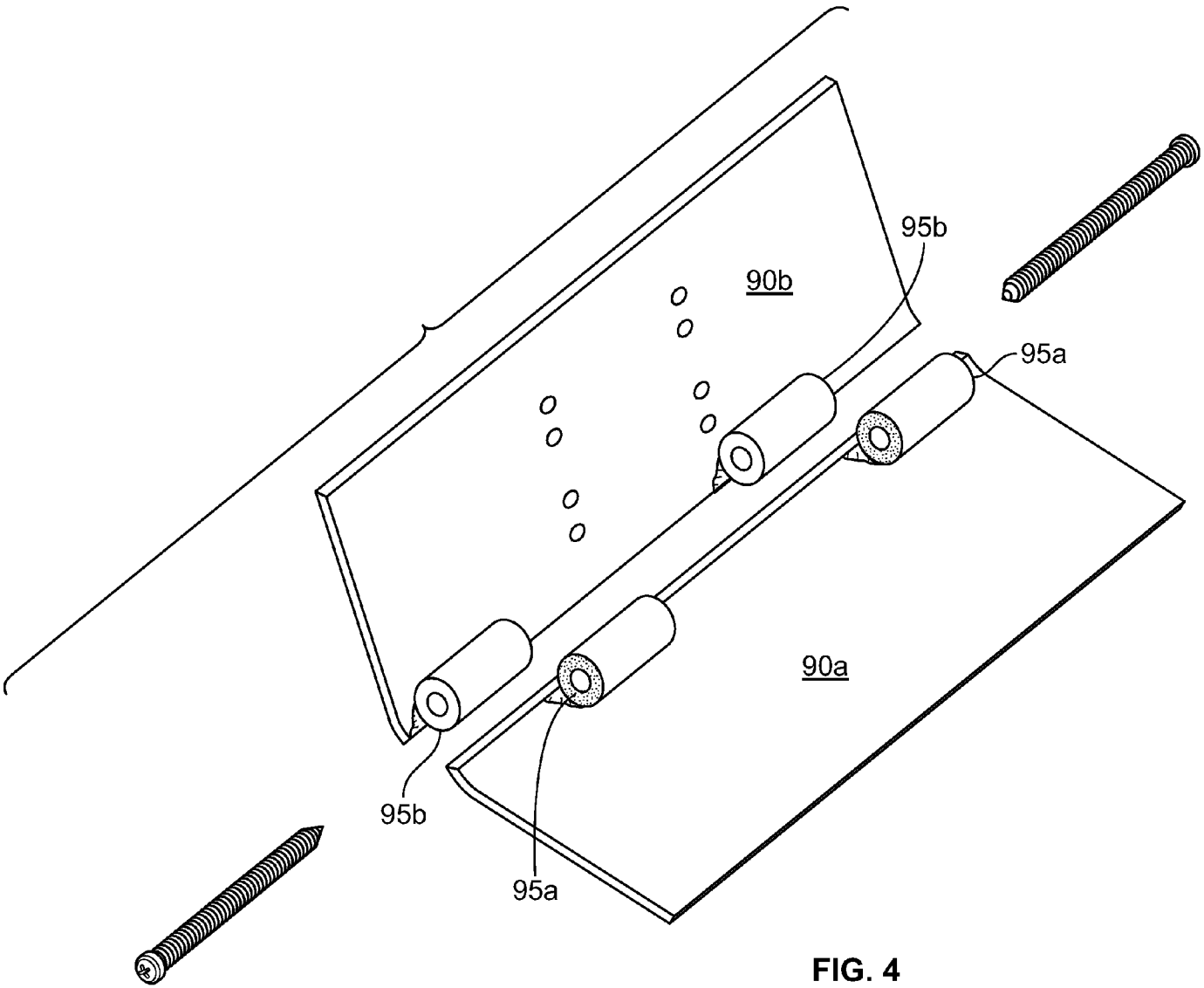
FIG. 4 is an exploded view according to an embodiment of the invention showing underside of cap, and how it may assemble.

FIG. 4 shows how cap portions 90*a* and 90*b* may be connected. In an embodiment, portion 90*a* comprises a region 95*a* that is capable of combining with a similarly formed region 95*b* of portion 90*b*. In an embodiment, 95*a* and 95*b* combine to form a hinge, which once in a proper arrangement and or angle of θ, may be locked in place by a screw, or other known means.

Figure 5:
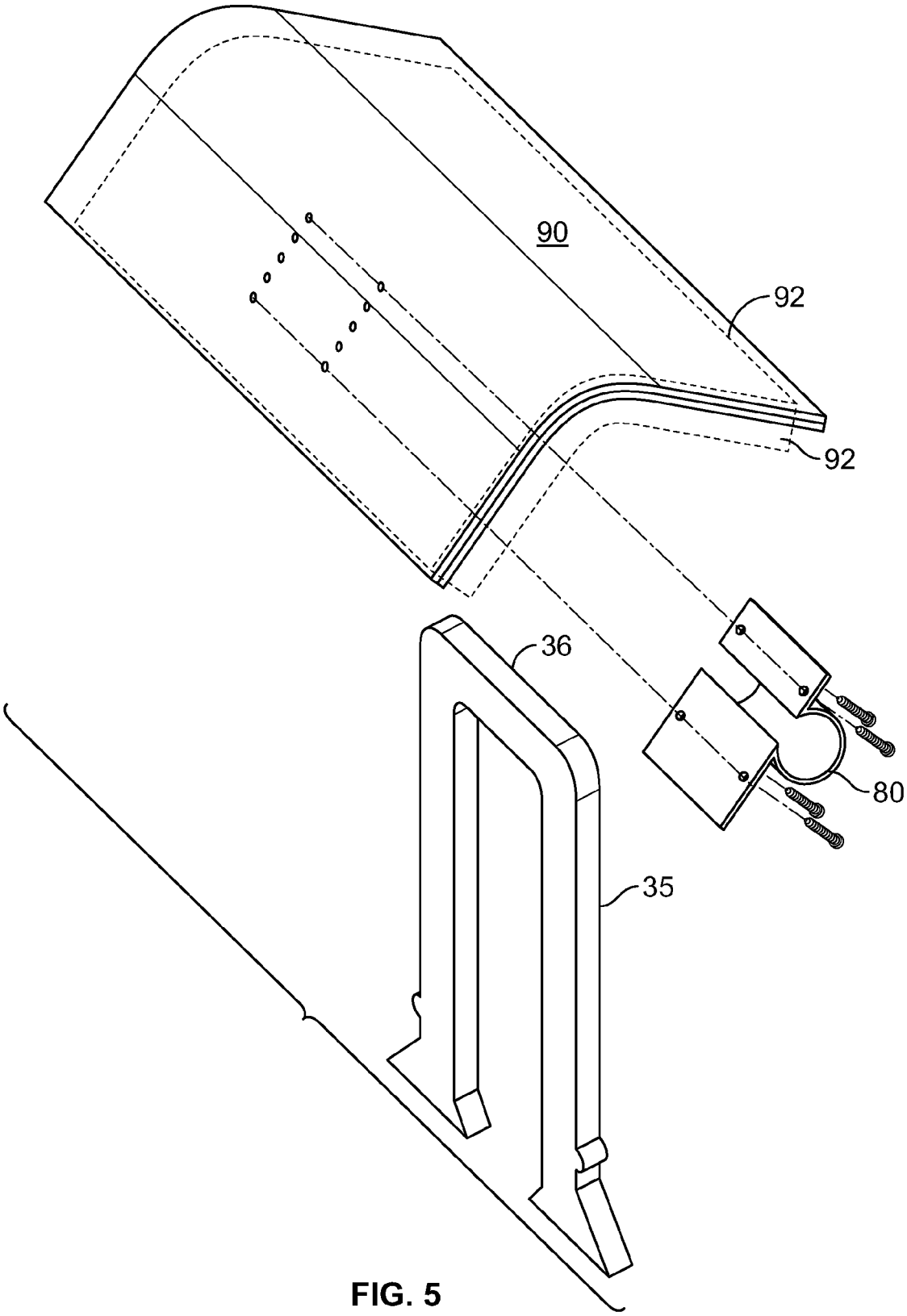
FIG. 5 is an exploded view according to an embodiment of the invention, showing how bracket may connect to cap.
Figure 6A:
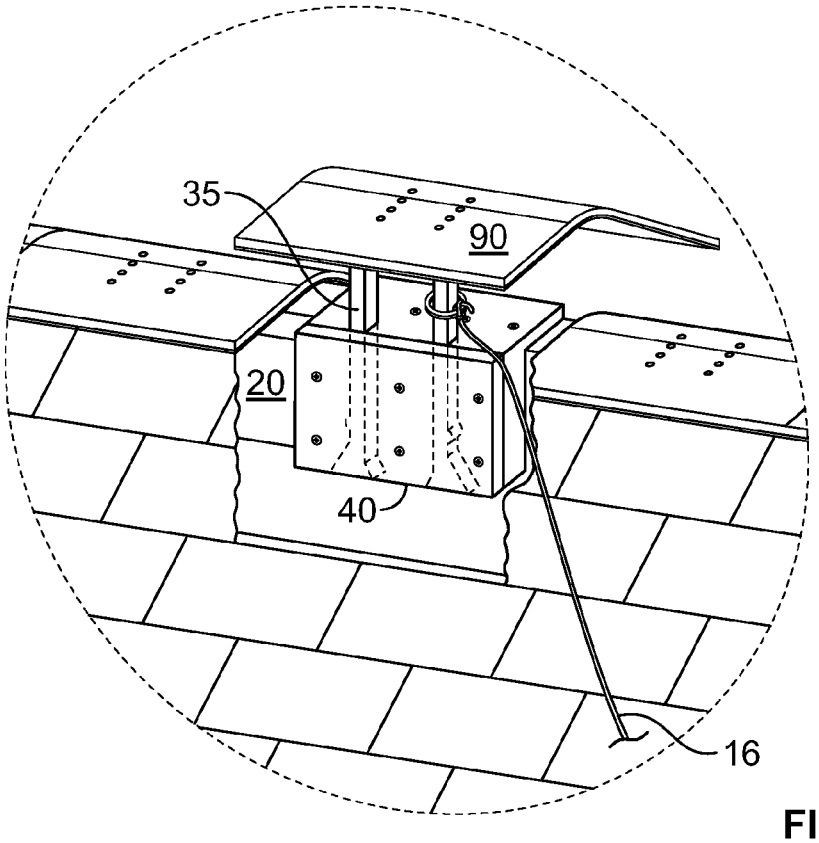
FIG. 6A is a perspective view of an embodiment of the invention when a structure is finished and safety device is in an operating state.
Figure 6B:
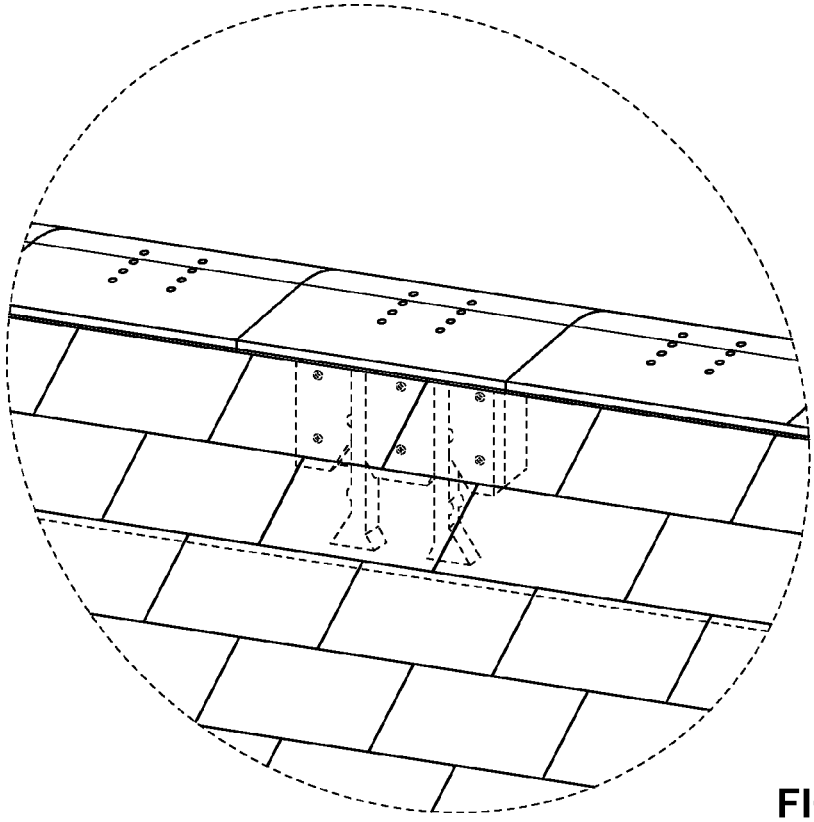
FIG. 6B is a perspective view of an embodiment of the invention when a structure is finished and safety device is in a storage state.

FIG. 5 shows an exploded view of the arrangement of bracket 80 connecting anchor 35 to cap 90. As shown, bracket 80 is used to join anchor 35 by connecting with its apex 36 and underside 91 of cap 90. The joining may be of a hinge-type connection wherein when rounded apex 36 of anchor 35 is similar to a pin. Similarly, connecting member 80 may be other known connectors like a C-bracket or other means that allow shingle to have a hinged type connection means in so far as there is an allowable error or movement allowed so that shingle 90 will lay flush with other shingles arranged on structure such as a roof when the device is in a retracted or stored state.

FIG. 5A shows an embodiment of how the invention may appear when in an actuated state, on a finished structure, such as a roof. FIG. 5B shows same in a retracted or storage state. As shown cap and or shingle 90 may be any article that is similar to those that are on a roof or similar structure. It is an embodiment of the invention where shingle 90 has an additional component such as it may be used to identify location of anchor 35, not shown. Furthermore, cap 90 may have a detachable handle (not shown) that may be selectively attached when necessary to actuate securing device 30, and thereafter removable after device 30 is retracted to a storage state. Additionally, it is an embodiment that the securing device may be actuated by a push-down-pop up mechanism such that anchor 35 is transferred to an actuated state when pressure is forced down on cap 90. And that anchor is thereafter locked in a retracted state when pressure is forced down on cap 90. Additional embodiments include cap 90 being shaped and sized different than other adjoining shingles or caps, having different coloring of adjoining, having distinguishing features such as a faux chimney or other object attached thereto which may include a faux animal such as a bird cat or other, and or having a portion therein capable of allowing a user to lift up shingle 90 for example or other similarly arranged cover with purpose of exposing securing device 30.

Various changes and modifications may be made without departing from the spirit and scope of the Invention and it is intended that such obvious changes and modifications be embraced by the annexed claims.

Having thus described the invention, what is claimed as new and desired to be secured by Letters Patent is:

1. A roof safety device that comprises a cleft anchor, capable of being transferred between an actuated state and a retracted state, comprising an apex having a first leg and a second leg extending thereform that is slideably engaged to a corresponding first and second channel formed within a mount attached to a portion of a roof, and a cap hindegly connected to said anchor.

2. The roof safety device of claim 1 wherein the mount comprises a locking mechanism that maintains the anchor in an actuated state.

3. The roof safety device of claim 1 wherein the anchor is shaped and sized to be biased in a retracted state.

4. The roof safety device of claim 3 further comprising a cap hingedly connected to said anchor.

5. The roof safety device of claim 4 wherein said cap is insulated such that there is no ingress of ambient matter when anchor is in a retracted state.

6. The roof safety device of claim 4 wherein said cap consists of two independent portions capable of pivoting about an axis.

7. A roof structure having a region comprising;

a truss;

a mount connected to said truss;

an anchor having a first portion for connecting to a safety line and a second portion that communicates with said mount such that the anchor may be transferred between an operating state and a storing state; and a cap hingedly connected to said anchor, such that when anchor is in a retracted state, a hinge allows said cap to match adjacent roofing.

8. The structure of claim 7 wherein the anchor is cleft, comprising two legs extending from an apex, wherein said legs slidably engage to a corresponding first and second channel, respectively, that are formed within said mount.

9. The structure of claim 7, wherein said channels have an inner area that has a portion capable of being deformed, and wherein a portion of said anchor has an outer area greater than said inner area, such that movement of said anchor becomes restricted when inner area is deformed.

10. The structure of claim 9 wherein said cap consists of two independent portions capable pivoting about an axis.

11. The structure of claim 7 wherein the cap is hingedly connected to said anchor, such that when anchor is in a retracted state, a hinge allows said cap to lay and look as adjacent caps.

12. The structure of claim 11 wherein said anchor is biased to be in an actuated state such that when said cap is displaced, the anchor automatically transitions from a retracted state to an actuated state.

13. A method of securing a line to a roof structure, comprising the steps of:

displacing a portion of a roof surface such that a truss of a roof structure is exposed and capable of receiving a safety device;

attaching a safety device to a portion of said roof structure;

actuating said safety device so that it is capable of connecting to a safety line;

hingedly connecting a cap to the safety device;

transitioning said safety device from an actuated state to a retracted state; and concealing the safety device such that a finished roofing structure is impervious to ambient matter.

14. The method of claim 13 further comprising the steps of:

releaseably attaching a handle to a portion of said cap such that the cap may be displaced by said handle in order to expose the safety device, then releasing said handle and concealing said safety device so that said roof structure is uniform.

* * * * *